United States Patent [19]

Kurdy

[11] 3,964,122

[45] June 22, 1976

[54] DENTAL HYGIENE DEVICE

[76] Inventor: George Kurdy, 454 W. 6th St., Long Beach, Calif. 90802

[22] Filed: Oct. 15, 1974

[21] Appl. No.: 514,639

[52] U.S. Cl. ..... 15/184; 15/167 R; 15/DIG. 5

[51] Int. Cl.[2] ..... A46B 9/04; A46B 17/04

[58] Field of Search ..... 15/167 R, 184, 185, 15/106, 110, 192, 193, DIG. 5; 132/84 R, 84 A, 89, 90, 93; 206/361; 401/269

[56] References Cited

UNITED STATES PATENTS

| | | | |
|---|---|---|---|
| 1,813,360 | 7/1931 | Priest | 132/84 A |
| 1,847,495 | 3/1932 | Priest | 132/84 A |
| 2,488,873 | 11/1949 | Maynard | 15/193 X |
| 2,633,236 | 3/1953 | Hempel | 15/184 UX |
| 2,943,344 | 7/1960 | Reed | 15/184 X |
| 2,945,252 | 7/1960 | Martineau | 15/184 X |
| 3,039,476 | 6/1962 | Reitknecht | 401/269 X |
| 3,078,856 | 2/1963 | Bender et al. | 132/93 |

FOREIGN PATENTS OR APPLICATIONS

| | | | |
|---|---|---|---|
| 226,076 | 5/1958 | Australia | 132/84 R |
| 936,082 | 2/1948 | France | 15/184 |
| 773,139 | 10/1934 | France | 15/184 |
| 169,312 | 8/1934 | Switzerland | 15/167 R |

*Primary Examiner*—Daniel Blum

[57] ABSTRACT

A compact dental hygiene device that may be easily carried in the pocket to permit a user thereof to concurrently brush his teeth and remove foreign material from the spaces therebetween.

1 Claim, 5 Drawing Figures

DENTAL HYGIENE DEVICE

BACKGROUND OF THE INVENTION

1. Field of the Invention

Dental hygiene device.

2. Description of the Prior Art

In the past, various types of toothbrushes have been developed and used, but these devices have the operational disadvantages that they cannot be carried in the pocket in a clean or sanitary condition, nor are they adapted to concurrently brush the teeth and remove foreign material from the spaces therebetween.

The primary object in devising the present invention is to overcome the operational disadvantages of the conventional prior art toothbrushes by providing a convenient dental hygiene device that may be carried in a clean and sanitary condition in a pocket of a user, as well as capable of being used to concurrently brush the teeth and remove foreign material from the spaces therebetween.

SUMMARY OF THE INVENTION

A compact dental hygiene device that includes an elongate handle having first and second end portions, with at least the first end portion being of tubular structure and defining an elongate cavity therein. The first end portion of the structure may be slidably and removably engaged by a cap. A group of first bristles are arranged in a ring shaped configuration, with the first end portions of these bristles disposed in the cavity. A group of second bristles which bristles are longer and the first bristles, are disposed in the center of the first bristles.

The second bristles have first ends that project outwardly from the dental device a greater distance than second ends of the first bristles. A body of bonding agent is secured to the first ends of the first and second bristles, as well as to the wall portion of the cavity to hold the first and second bristles therein as a unit. Due to the different lengths of the first and second bristles, the second ends thereof are so disposed relative to one another that they may be brought into moving engagement with the surface of the teeth as well as the spaces therebetween to remove foreign material therefrom.

DESCRIPTION OF THE PREFERRED EMBODIMENT

Figure 1:
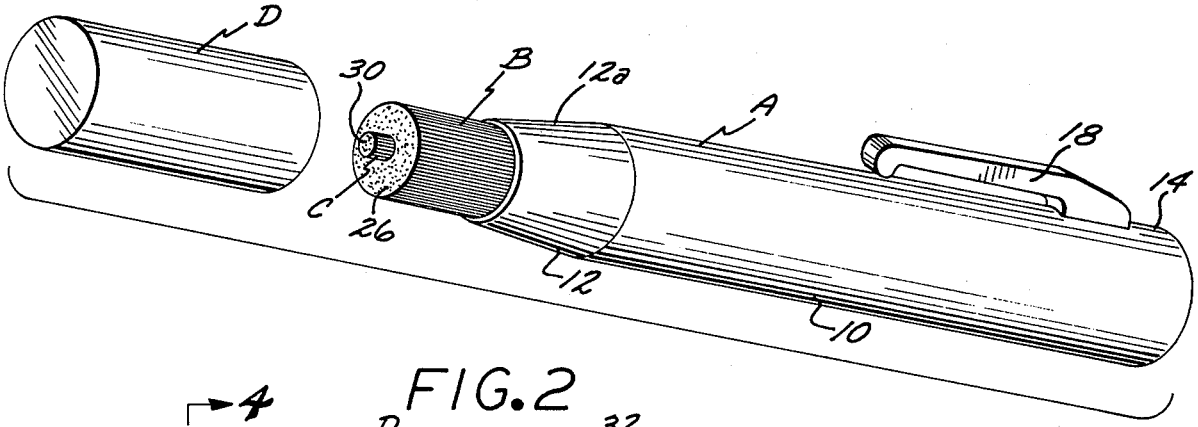
FIG. 1 is a perspective view of the dental hygiene device with the cap removed therefrom.

The dental hygiene device A, as can best be seen in FIG. 1, includes an elongate handle 10 formed from a polymerized resin or like material, with the handle 10 having a first end portion 12 and a second end portion 14. The first end portion 12 is formed with a longitudinally extending, tapered, external cylindrical surface 12*a*.

Figure 2:
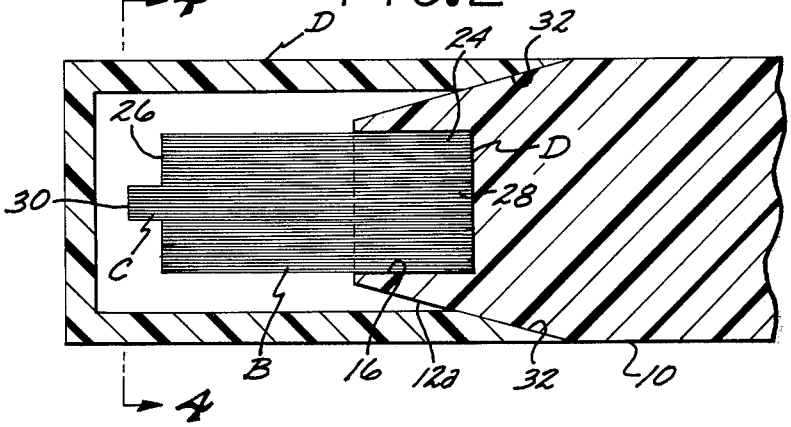
FIG. 2 is a fragmentary longitudinal cross sectional view of a first end portion of the device with the cap mounted thereon.
Figure 5:
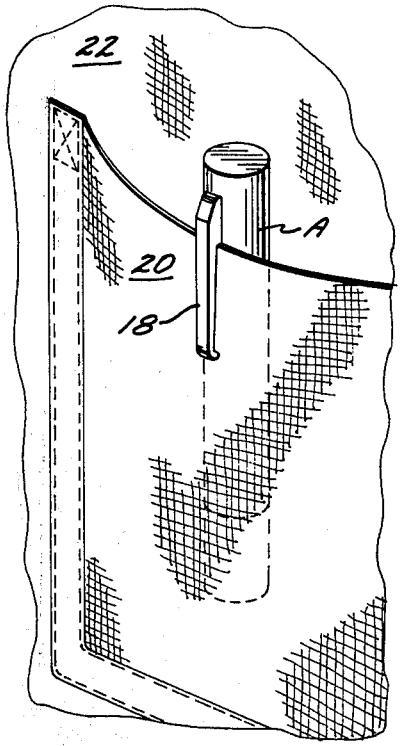
FIG. 5 is a perspective view of the dental hygiene device removably supported in a pocket of a garment.

The first end portion 12 has a longitudinally extending cavity 16 formed therein as best seen in FIG. 2. The second end portion 14 of handle 10 has a clip 18 mounted thereon that permits the dental hygiene device A to be removably supported in a pocket 20 of a garmet 22 as illustrated in FIG. 5. The dental hygiene device A includes a number of first bristles B that are arranged side by side as may best be seen in FIGS. 1 and 2, and these bristles having first end portions 24 that are disposed in the cavity 16. The first bristles B are arranged in a ring shaped configuration to define an opening in the center thereof. The first bristles B have second free ends 26 that are outwardly disposed from the handle 10 as shown in FIG. 2.

The dental hygiene device A also includes a number of second bristles C that are centrally disposed within the first bristles B, and the second bristle having first end portions 28 that are situated in the cavity 16. The second bristle C are a greater length than the first bristles B, and have second ends 30 that are outwardly disposed relative to the first ends 26 as shown in FIG. 2. A body of bonding agent D is positioned in the cavity 16 and serves to bond the first end portions of the first and second bristles B and C together as well as bond these portions of the bristles to the wall that defines cavity 16. An elongate cap D is provided as best seen in FIG. 1 which has a tapered interior surface 32 that removably and frictionally engages the surface 12*a*, to removably support the cap D on the handle 10 as shown in the FIGS. 2 and 5.

Figure 3:
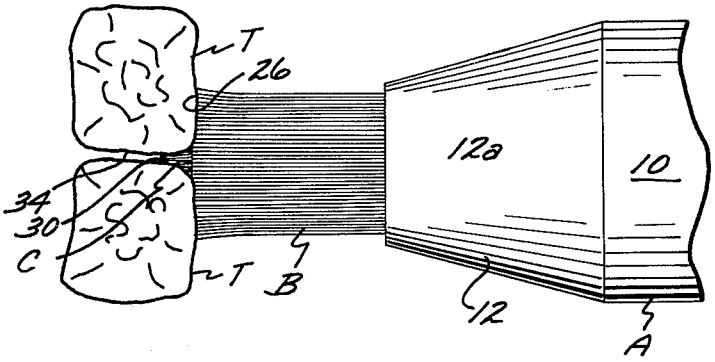
FIG. 3 is a fragmentary view of the first end portion of the device, with the first and second bristles in engagement with the teeth and the spaces therebetween.
Figure 4:
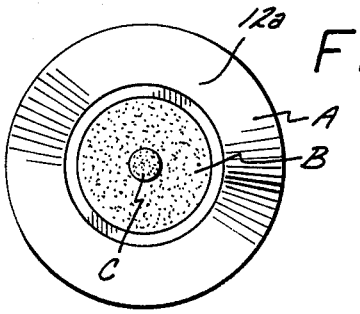
FIG. 4 is an end elevational view of the first portion of the device.

When it is desired to use the dental hygiene device A, the cap D is removed therefrom and the second ends 26 and 30 of the first and second bristles B and C are moved into contact with the teeth T, as shown in FIG. 3, and by such movement removes foreign material therefrom as well as foreign material from the spaces 34 between the teeth. After the teeth T have been cleaned, the cap D is mounted on the handle A as shown in FIG. 2, with the dental hygiene device A then being returned to the pocket 20 until again needed.

The use and operation of the invention has been described previously and need not be repeated.

I claim:

1. A dental hygiene device of the type that includes an elongate solid handle that has first and second end portions, tooth brushing means supported from said first end portion, and a cap that is removably mounted on said first end portion and envelops said brushing means when the latter is not in use, wherein the improvement is in said brushing means, said improvement comprising:

a. a plurality of first and second bristles, said second bristles of greater length than said first bristles, said first and second bristles having second free ends and first end portions, said first bristles adjacently disposed in parallel relationship to define an annulus shaped body, said second bristles adjacently disposed in parallel relationship within said annulus shaped body to define a cylindrical body, with said second free ends of said second bristles disposed outwardly from said second ends of said first bristles a substantial distance, said first end portions of said first and second bristles disposed in a cavity in said first end of said handle and axially aligned with said handle; the said free ends of the first and second bristles terminating in spaced parallel substantially perpendicular to the length of the handle and b. a body of bonding agent in said cavity that holds said first end portions of said first and second bristles together therein as an integral unit, said device when said cap is removed therefrom capable of being manually used to clean the teeth of a user when said second free ends of said bristles are brought into pressure rubbing contact therewith, with said second ends of said first bristles when said contact is so made contacting the exterior surfaces of the teeth, and said second ends of said second bristles as said contact is so made entering the spaces between said teeth to dislodge foreign material therefrom.

* * * * *